US005369855A

United States Patent [19]

Tokugawa

[11] Patent Number: 5,369,855

[45] Date of Patent: Dec. 6, 1994

[54] BUCKLE FOR SEAT BELT

[75] Inventor: Osamu Tokugawa, Kanagawa, Japan

[73] Assignee: NSK Ltd., Tokyo, Japan

[21] Appl. No.: 66,656

[22] Filed: May 25, 1993

[30] Foreign Application Priority Data

May 26, 1992 [JP] Japan ..... 4-041432[U]

[51] Int. Cl.[5] ..... A44B 11/00

[52] U.S. Cl. ..... 24/641; 24/637

[58] Field of Search ..... 24/641, 633, 636, 637, 24/638, 645, 646, 651

[56] References Cited

U.S. PATENT DOCUMENTS

| | | | |
|---|---|---|---|
| 4,451,958 | 6/1984 | Robben et al. | 24/636 |
| 4,575,907 | 3/1986 | Takada | 24/641 |
| 5,066,042 | 11/1991 | Föhl | 280/806 |
| 5,097,571 | 3/1992 | Föhl | 24/641 |
| 5,115,543 | 5/1992 | Föhl | 24/633 |

FOREIGN PATENT DOCUMENTS

| | | | |
|---|---|---|---|
| 0040143 | 11/1981 | European Pat. Off. | 24/641 |
| 4007915 | 9/1990 | Germany . | |
| 3842453 | 5/1992 | Germany . | |
| 3222904 | 10/1991 | Japan . | |
| 3277301 | 12/1991 | Japan . | |
| 2227513 | 8/1988 | United Kingdom . | |
| 2242479 | 2/1991 | United Kingdom . | |

*Primary Examiner*—Victor N. Sakran

*Attorney, Agent, or Firm*—Sughrue, Mion, Zinn, Macpeak & Seas

[57] ABSTRACT

It is object of the present invention to provide a buckle for a seat belt having an excellent double lock function that can surely lock the latching by a latching member even against impact in any directions without impairing normal operability. The buckle for a seat belt for keeping passengers of an automobile securely seated, which includes: a buckle base (2); an ejector (24) for biasing a tongue plate (36) inserted into the buckle base (2) in the tongue plate extracting direction; a latching member (11), journaled to the buckle base (2) , for blocking the tongue plate (36) from moving in the tongue plate extracting direction by latching the tongue plate (36) inserted into the buckle base (2) while opposing a biasing force of the ejector (24); a locking member (40) for regulating rotation of the latching member (11) in an unlatching direction; a push button (21) for unlatching the torque plate (36) from the latching member (11); and an arm member (50), rotatably supported by the push button (21), for blocking the push button (21) from moving in the push button pushing direction when the push button (21) is subjected to impact.

10 Claims, 5 Drawing Sheets

BUCKLE FOR SEAT BELT

BACKGROUND OF THE INVENTION

The invention relates to buckles for seat belts and, more particularly, to an improvement of a buckle for a seat belt having a double lock mechanism.

Conventional buckles designed for seat belts for keeping passengers and the like securely seated include a buckle base, a latch mechanism for releasably latching a tongue plate to an end of the buckle base, and a buckle cover for enclosing the latch mechanism. The buckle base is firmly secured to the body of an automobile through brackets, wires, or the like, and transmits a tensile load acting upon the webbing to the body of the automobile at the time a collision of automobiles is accidentally occurred. Further the latch mechanism allows the tongue plate to be detachably coupled with the buckle base to thereby facilitate the fastening and releasing of the seat belt. When the tongue plate is inserted into the buckle base, a latching member prevents the tongue plate from being extracted by engaging a latching hole of the tongue plate.

The seat belt buckle of this type includes a buckle having a so-called double lock mechanism. In the double lock mechanism, the locking member keeps the latching of the latching member positively locked so that the tongue plate can be kept latched even if the buckle is subjected to impact after the tongue plate has been fitted into the buckle base by insertion, and the locking member can be unlocked by a simple operation of an operating member so that the latching of the tongue plate can be released.

However, in the buckle having such the double lock mechanism, the locking member, which is biased by a spring in a locking direction to block the latching member from rotating in an unlatching direction and thereby keeping the tongue plate latched by the latching member, might move from the locking position if large impact such as a collision of automobiles is accidentally applied in the unlocking direction that is opposite to the biasing direction. Further, the tongue plate might be unlatched if an inertial force is applied in an operating member operating direction and the operating member has moved by such inertial direction.

To overcome these problems, the following buckle is disclosed in Japanese Patent Unexamined Publication No. Hei. 3-222904 (1991). The latching member is arranged so as to be swingable and horizontally movable in the same direction as the tongue plate inserting and extracting direction. When an inertial force is applied to the buckle in such a direction as to cause the locking member to move from the locking position, the buckle is designed such that the catch of the latching member is held by a holding member provided on the buckle cover or the buckle base so as to allow the latching member to keep latching the tongue plate, or such that an auxiliary locking member moves to the locking position so as to allow the latching member to keep latching the tongue plate before the locking member moves from the locking position by an inertial force.

Further, another buckle proposed in Japanese Patent Unexamined Publication No. Hei. 3-277301 (1991) includes a swingable movement control member on the operating member, so that when an inertial force acts on the buckle in such a direction as to cause the locking member to move from the locking position, the movement control member can block the locking member from moving and the latching member can thereby keep latching the tongue plate.

However, the designing of the components of the thus constructed seat belt buckles is difficult. In addition, the operation of the lock mechanism that keeps the latching member latching the tongue plate is liable to be unstable, and the operability thereof under the normal condition is easy to be impaired.

That is, in the case of the buckle in which the catch of the latching member is held by the holding part arranged on the buckle cover or the buckle base to keep the latching member latching the tongue plate, the latching member must be arranged so as to be swingable and horizontally movable. It is for this reason that the operation of the latching member is liable to be unstable.

Further, in the case of the buckle having the auxiliary locking member, if the operating member moves in the operating direction faster than the auxiliary locking member due to impact, the locking member is caused to move from the locking position before the auxiliary locking member moves to the locking position to keep the latching member latching the tongue plate. As a result, the latching member may, in some cases, fail to keep latching the tongue plate.

Still further, in the case of the buckle having the movement control member for blocking the movement of the locking member, the movement of the locking member due to impact cannot be blocked unless the locking member moves from the locking position before the operating member. This requires that initial resistances necessary for operating the respective components be set correctly. Such setting is difficult. In addition, if the latching member is located at the unlatching position under the normal condition, the movement control member is caught by the latching member. This keeps the operating member from returning to the original position with the operating member remaining pushed.

SUMMARY OF THE INVENTION

An object of the invention is therefore to overcome the above problems by providing a buckle for a seat belt having an excellent double lock function that allows the latching member to latch surely even against impact applied from any direction without impairing normal operability.

To overcome the above object, a first aspect of the invention is applied to a buckle for a seat belt for keeping passengers of an automobile securely seated, which includes:a buckle base; an ejector for biasing a tongue plate inserted into the buckle base in the tongue plate extracting direction; a latching member, journaled to the buckle base, for blocking the tongue plate from moving in the tongue plate extracting direction by latching the tongue plate inserted into the buckle base while opposing a biasing force of the ejector; a locking member for regulating rotation of the latching member in an unlatching direction; a push button for unlatching the tongue plate from the latching member; and an arm member, rotatably supported by the push button, for blocking the push button from moving in the push button pushing direction when the push button is subjected to impact.

A second aspect of the invention is applied to a buckle, in which the locking member is swingably journaled to the buckle base by a rotating shaft in such a manner that a position of the latching member can be controlled in the latching direction at a latch holding side of the locking member adjacent to a base bottom side.

A third aspect of the invention is applied to a buckle, in which the arm member is biased in a direction opposite to the push button pushing direction and rotatable in the push button pushing direction by an inertial force acting in the push button pushing direction. In such a buckle, an end of the arm member having been rotated by the inertial force abuts against a side opposite to the latch holding side while interposing the rotating shaft of the locking member between the end and the latch holding side, so as to block the push button from moving in the push button pushing direction.

A fourth aspect of the invention is applied to a buckle, in which the locking member includes a locking pin, a pair of plate parts, and a rod part for mounting the plate parts. In such a buckle, the rod part has a stopper projection projecting upward.

A fifth aspect of the invention is applied to a buckle, in which the arm member blocks the push button from moving in the push button pushing direction by being rotated and thereby abutting against the stopper projection (44) of the locking member.

A sixth aspect of the invention is applied to a buckle, in which the arm member includes the abutting part for abutting against the stopper projection of the locking member.

A seventh aspect of the invention is applied to a buckle, in which the arm member is biased in the direction opposite to the push button pushing direction and is rotatable in the push button pushing direction by an inertial force acting in the push button pushing direction.

An eighth aspect of the invention is applied to a buckle, in which the arm member is biased in the direction opposite to the push button pushing direction by a torsional coil spring.

According to the invention, the arm member is rotated to block the movement of the push button in the push button pushing direction by abutting against the stopper projection of the locking member when the push button is receives such a force as to cause the latching member to unlatch the tongue plate while the latching member is latching the tongue plate. The locking member also operates in such a direction as to allow the latching member to keep latching the tongue plate. As a result, the lock mechanism is not fallen off by impact or the like. Further, when the impact or the like is no longer present, the arm member can return to a stand-by position quickly and accurately.

DETAILED DESCRIPTION OF THE PREFERRED EMBODIMENT

An embodiment of the invention will now be described in detail with reference to the accompanying drawings.

Figure 1:
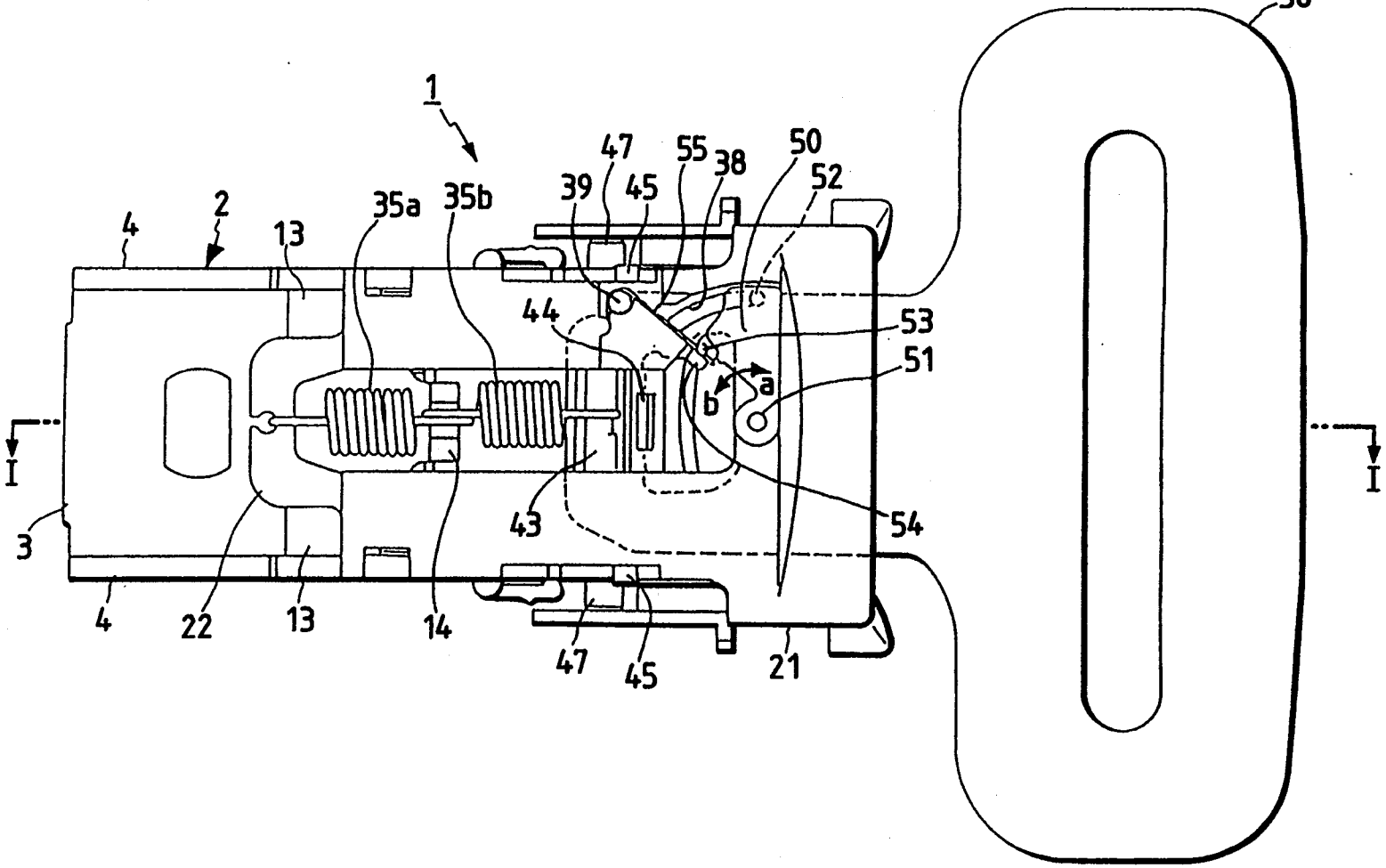
FIG. 1 a plan view showing a buckle for a seat belt, which is an embodiment of the invention.
Figure 2:
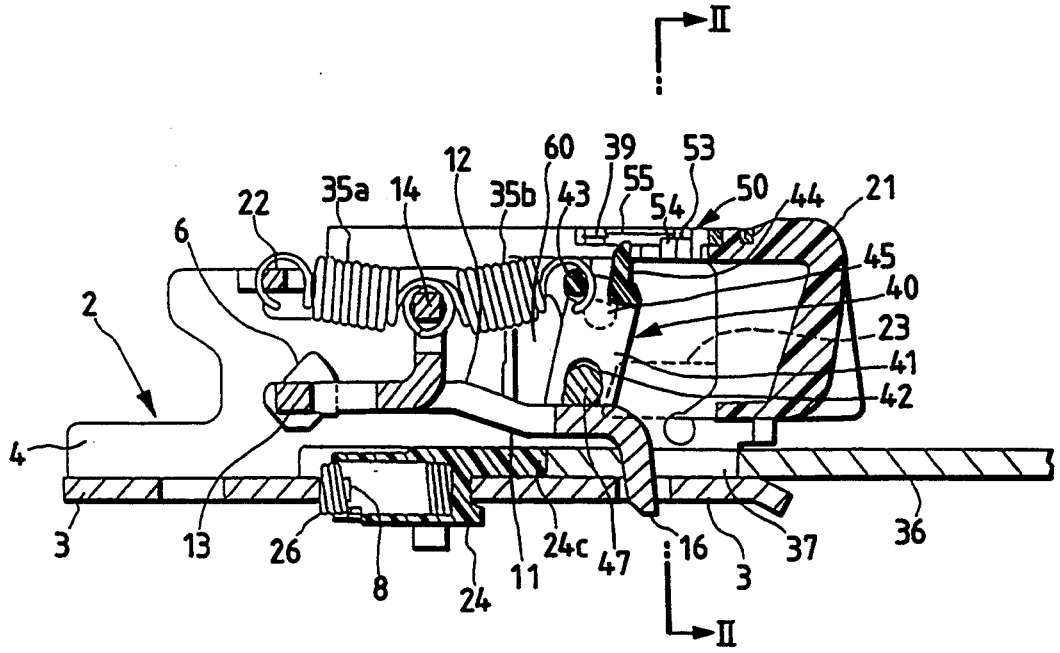
FIG. 2 is a longitudinal sectional view showing a portion taken along a line II—II of the buckle for a seat belt shown in FIG. 1.
Figure 8:
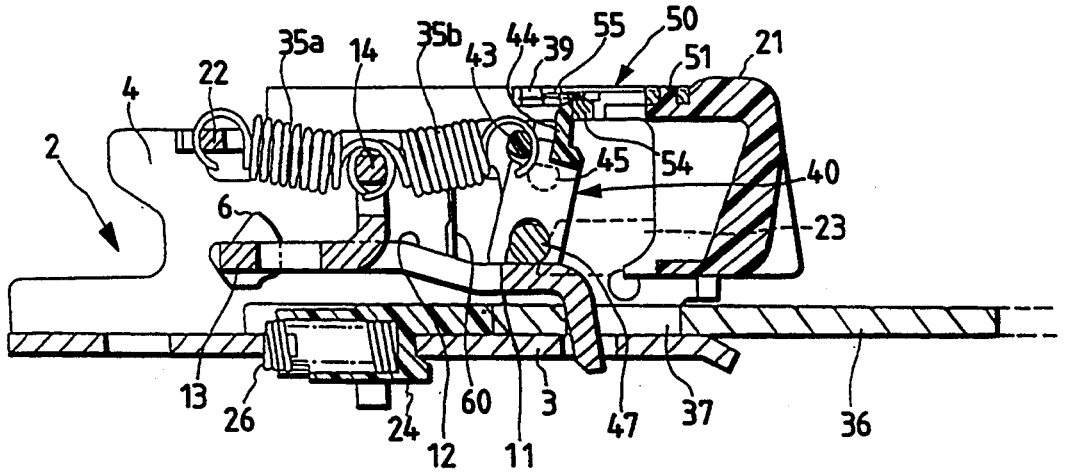
FIG. 8 is a sectional view showing a state in which the arm member corresponding to a portion taken along a line VIII—VIII of the buckle for a seat belt shown in FIG. 7 has been operated.
Figure 3:
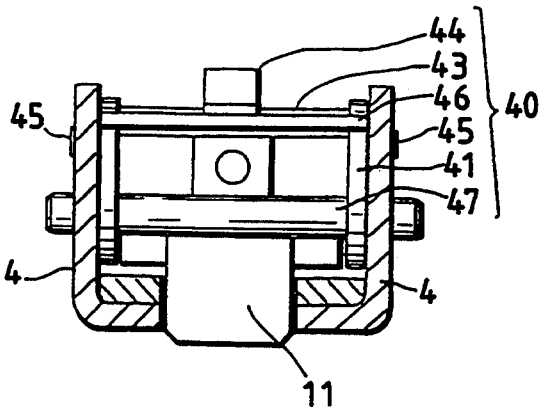
FIG. 3 is a horizontal sectional view showing a portion taken along a line III—III in FIG. 2.

FIG. 1 is a plan view showing the body 1 of a buckle for a seat belt according to the invention; FIG. 2 is a sectional view showing a portion taken along a line II-II of FIG. 1; and FIG. 3 is a sectional view showing a portion taken along a line III—III of FIG. 2.

The buckle body 1 includes: a buckle base 2; a latch mechanism and a lock mechanism attached to the buckle base 2; and not shown upper and lower covers for covering these components in a manner similar to the conventional example.

The buckle base 2 is formed by blanking, e.g., a plate-like member and has a base bottom 3 in the middle thereof. On both sides of the base bottom are base side walls 4 formed by bending the base bottom substantially upright, so that a path. for guiding the insertion of a tongue plate 36 can be provided. The tongue plate 36 is inserted along this guide path.

The base bottom 3 includes: a slide guide hole 7 for guiding an ejector 24 that can abut against the inserting end of the tongue plate 36; and a spring guide 8 into which a compression coil spring 26 for biasing the ejector 24 forward The ejector 24 has a guide projection that is fitted with the slide guide hole 7, a stopper for stopping the ejection of the ejector 24, and the like. Also, the ejector 24 has an abutting surface 24*c* that is fitted with the inserting end of the tongue plate 36 on a front surface thereof.

A latching member 11 is a substantially L-shape plate-like member having a horizontal plate part 12 and a catch 16 that is substantially vertically bent downward on the front edge thereof. A leg part 13 projecting from both edges of the rear side is rotatably supported by latch support holes 6 formed on the base side walls 4. The catch 16 is fitted into a latching hole 37 of the tongue plate 36, so that unlatching of the tongue plate 36 can be prevented. In the middle of the horizontal part 12 is a holding part 14 that projects in a direction opposite to the direction of the catch 16. This holding part 14 holds one end of a coil spring 35*a* whose other end is held by a holding part 22 of a push button 21. Also, the holding part 14 holds one end of a coil spring 35*b* whose other end is held by a rod part 43 of a locking member 40, which will be described below.

The locking member 40 is arranged above the latching member 11. The locking member 40 blocks rotation of the latching member 11 in an unlatching direction. As shown in FIGS. 2 and 3, the locking member 40 is provided with a locking pin 47 and two rod parts 43, 46 for bridging a pair of plate parts 41 extending along the base side walls 4. On the plate parts 41 are a rotating shaft 45 rotatably supported on the base side walls 4 and long holes 42 for holding the locking pin 47 with some play. Further,.the rod part 46 has a stopper projection 44 projecting upward as viewed in FIGS. 2 and 3, which can be fitted with an arm member 50 (described later).

The locking pin 47 not only passes through the long holes 42, but also is movably held by L-shaped holes 60 formed on the base side walls 4. The locking pin 47 abuts against the horizontal plate part 12 of the latching member 11 so that the latching member 11 is positioned.

Figure 4:
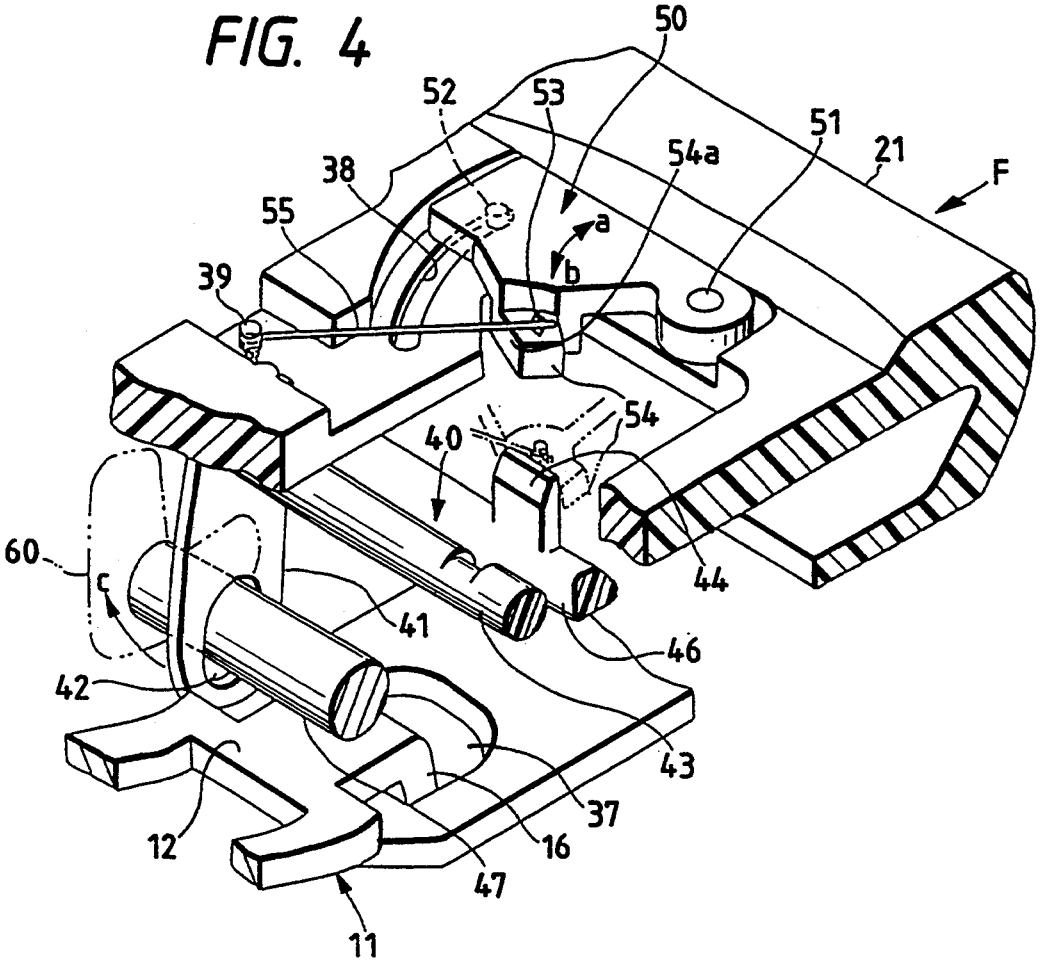
FIG. 4 is a perspective view showing the main portion of the buckle for a seat belt shown in FIG. 1.

The arm member 50 is rotatably arranged so as to be part of the upper surface of the push button 21, e.g., as shown in FIG. 4. The arm member 50 includes: a rotating shaft 51 around which the arm member 50 rotates; a pin part 52 guided by an arcuate rotating groove 38; and a spring holding part 53. The arm member 50 is biased in a direction indicated by an arrow "a" by a torsional coil spring 55 held by a holding shaft 39 at the left of the arm member 50 viewed in FIG. 4.

The push button 21 is attached to the buckle base 2 so as to be movable along the tongue plate inserting direction, and is biased forward by a biasing force of the coil spring 35*a* held by the holding part 22 arranged on the rear end of the buckle base 2. It goes without saying that the push button is appropriately fitted so as not to fall off the buckle base 2.

A projecting part 23 of the push button 21 confronts the locking pin 47 so as to be abuttable thereagainst. By pushing the push button 21 while opposing the biasing force of the coil spring 35*a*, the projecting part 23 abuts against the locking pin 47, so that the locking pin 47 moves first backward and then upward while guided toward the L-shaped holes 60. Further, the locking member 40 swings around the rotating shaft 45 in a direction indicated by an arrow 37 c" in association with the movement of the locking pin 47 while opposing the biasing force of the coil spring 35*b*. This causes the locking member to unlock the latching member.

Still further, when the push button 21 is pushed with the coil spring 35*a* held by the holding part 22 of the push button 21 being latched by the holding part 14 of the latching member 11 as described above, the coil spring 35*a* acts so as to pull the holding part 14 obliquely upward. This causes the latching member 11 to be rotated in the unlatching direction, causing the catch 16 to be extracted.

Then, the operation of latching and locking the torque plate of the buckle body 1 will be described with reference to FIGS. 5 through 8.

Figure 5:
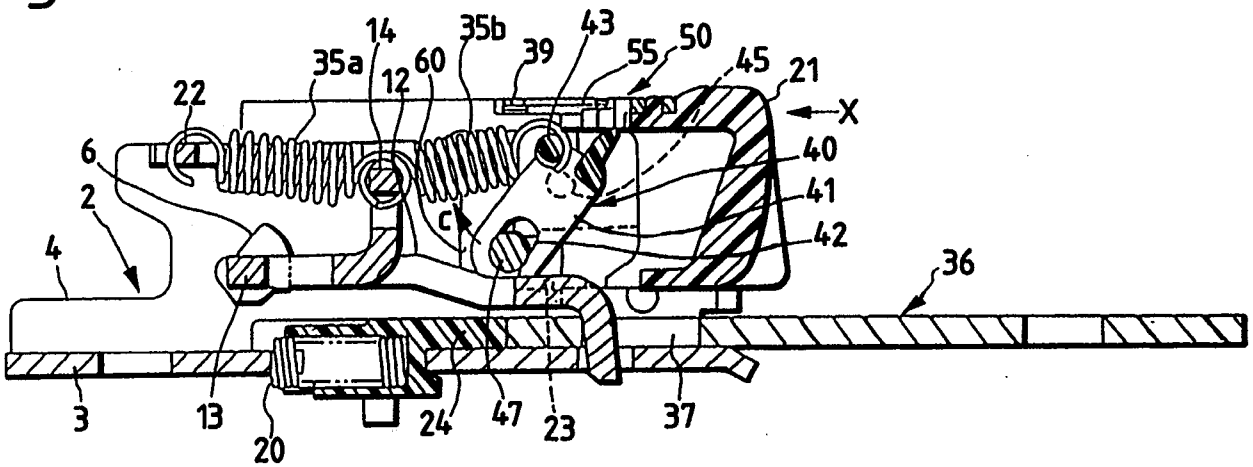
FIG. 5 is a longitudinal sectional view for describing the operation of detaching a tongue plate of the buckle for a seat belt shown in FIG. 1.

With the tongue plate 36 being inserted to the buckle base 2, the front end of the tongue plate 36 abuts against the abutting surface 24*c* of the ejector 24, whereas the catch 16 of the latching member 11 is fitted into the latching hole 37 of the tongue plate 36. When the push button 21 is pushed in the direction indicated by an arrow X as shown in FIG. 5 under this condition, the projecting part 23 causes the locking pin 47 to move to the left viewed in FIG. 5 by pushing the locking pin 47. The movement of the locking pin 47 causes the locking member 40 to rotate clockwise around the rotating shaft 45.

Figure 6:
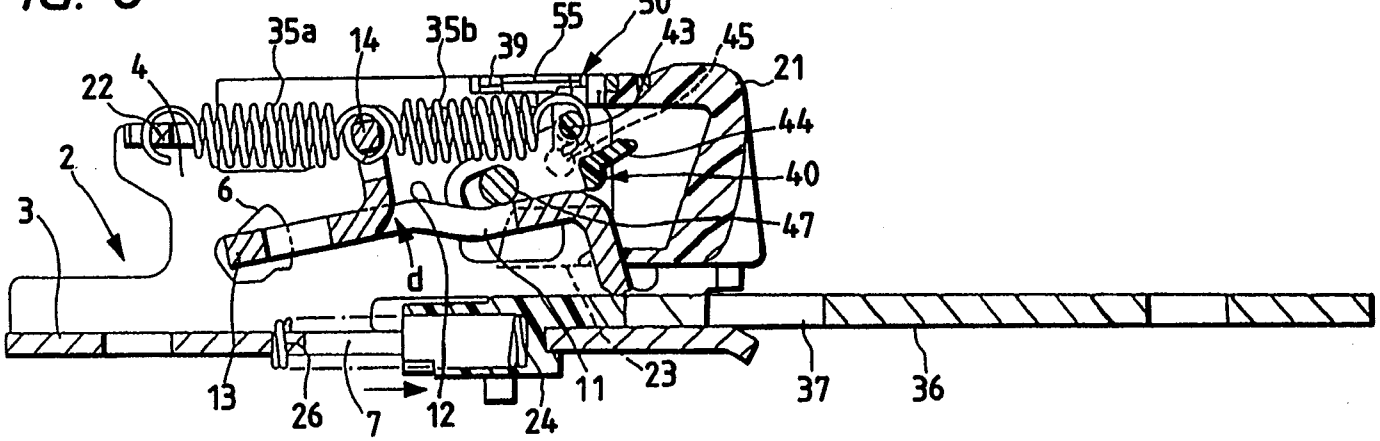
FIG. 6 is another longitudinal sectional view for describing the operation of detaching the tongue plate of the bubble for a shown in FIG. 1.

As the push button 21 is pushed continuously, the locking pin 47 is pulled upward by the tapered surface of the front end of the projecting part 23, thereby moving along the L-shaped holes 60 (the condition shown in FIG. 6). At this point, the latching member 11, being pulled backward and obliquely upward by the coil spring 35*a*, starts rotating counterclockwise (in the direction indicated by an arrow "d") around the leg part 13. As the catch 16 has been extracted from the latching hole 37 of the tongue plate 36 by such rotation, the tongue plate 36 is thrown out by the ejector As the pushing of the push button 21 is released thereafter, the coil spring 35*a* returns to the original position by the recovering force thereof. Under this condition, the latching member 11 is biased clockwise (in the direction opposite to the direction indicated by the arrow "d") by the appropriately expanded coil spring 35*b*. Therefore, upon insertion of the tongue plate 36, the ejector 24 retreats relative to the catch 16 to allow not only the tongue plate 36 to replace the ejector 24 but also the catch 16 to be automatically fitted into the latching hole 37 as shown in FIG. 2.

The operation of the arm member 50 will be described. As shown in FIG. 2, if large impact such as a collision of automobiles is applied under a state in which the catch 16 of the latching member 11 is fitted into the latching hole 37 of the tongue plate 36, then the push button 21 may, in some cases, be pushed by such inertia as to produce a force F (the force indicated by an arrow F in FIGS. 4 and 7) that acts in the same direction as in the pushing operation described above.

Figure 7:
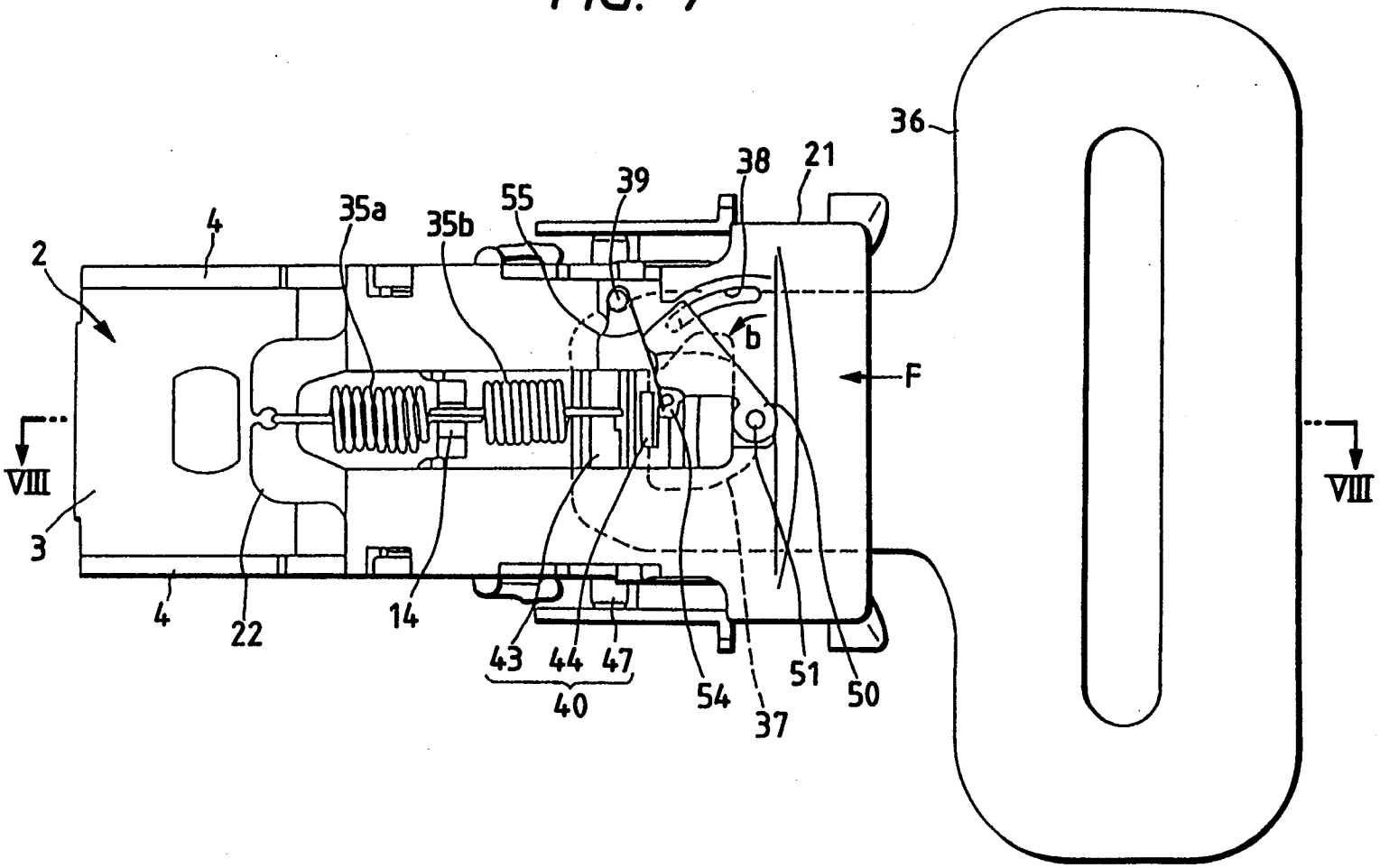
FIG. 7 is a plan view showing a state in which an arm member of the buckle for a seal belt shown in FIG. 1 has been operated.

In this case, as shown in FIGS. 4 and 7, the arm member 50 rotates counterclockwise (in the direction indicated by an arrow "b") against the biasing force of the torsional coil spring 55. The arm member 50 rotates up to a position indicated by a phantom line in FIG. 4, i.e., a position where an outer circumferential surface 54*a* which is part of the abutting part 54 and which is opposite to the rotating shaft 51 confronts the stopper projection 44 of the locking member 40. The stopper projection 44 is juxtaposed to the rotating shaft 51 on a line that runs in parallel with the direction in which the push button 21 moves. The above-described rotation allows the outer circumferential surface 54*a* to intersect such parallel line substantially orthogonally when the abutting part 54 is aligned with the parallel line.

Even if the push button 21 starts moving upon completion of the rotation of the arm member 50, the push button 21 is not allowed to move in the pushing direction due to the stopper projection 44 abutting against the abutting part 54. This abutting force acts upon the locking member 40 in such a manner as to push the locking member in the Locking direction, so that the locking performance can be further ensured. To complete the rotation of the arm member 50 quickly before the push button 21 starts moving, it is necessary to design the strength and operating distance of the coil spring 35*a* and the torsional coil spring 55 to proper values.

If the impact (indicated by the arrow F) is no longer present, the arm member 50 returns to the original stand-by position by the force of the torsional coil spring 55. Therefore, the tongue plate 36 can be unlatched by the pushing operation of the push button 21.

In the embodiment of the present invention, the push button 21, the ejector 24, the locking member 40, the rod parts 43 and 46 are made of a synthetic resin.

The application of the invention is not limited to the above-described embodiment. For example, the shape and structure of the biasing means of the arm member 50 can be modified in various ways as appropriate. The push button, the latching member, the locking member, the spring members, and the like may, of course, take various forms as well.

As described in the foregoing pages, the buckle for a seat belt according to the invention is characterized as allowing a locking condition of the locking member, which blocks the rotation of the latching member fitted with the tongue plate in the unlatching direction, to be surely released by a simple push button operation and as allowing the movement of the push button to be surely blocked even if the push button is subjected to such a force as to cause the push button to move. Therefore, any accidental unlocking of the latching member can be prevented, which allows a buckle for a seat belt having an excellent double lock mechanism that can lock the latching member at all times to be provided.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the .invention in various embodiments and with various modifications as are suited to the particular use contemplated. It is intended that the scope of the invention be defined by the claims appended hereto, and their equivalents.

What is claimed is:

1. A buckle for a seat belt for keeping passengers of an automobile seated securely, comprising:

a buckle base;

an ejector for biasing a tongue plate inserted into the buckle base in the tongue plate extracting direction;

a latching member, journaled to the buckle base, for blocking the tongue plate from moving in the tongue plate extracting direction by latching the tongue plate inserted into the buckle base while opposing a biasing force of the ejector;

a locking member for regulating rotation of the latching member in the releasing direction;

a push button for releasing the tongue plate from the latching member; and an arm member, supported by the push button and rotatable in the push button direction by an inertial force acting in the push button pushing direction, for blocking the push button from moving in the push button pushing direction when the push button is subjected to impact.

2. A buckle according to claim 1, wherein the locking member is swingably journaled to the buckle base by a rotating shaft in such a manner that a position of the latching member can be controlled in the latching direction at a latch holding side of the locking member adjacent to a base bottom side.

3. A buckle according to claim 2, wherein the arm member is biased in a direction opposite to the push button pushing direction, and wherein an end of the arm member having been rotated by the inertial force abuts against a side opposite to the latch holding side while interposing the rotating shaft of the locking member between the end and the latch holding side, so as to block the push button from moving in the push button pushing direction.

4. A buckle according to claim 1, wherein the locking member includes a locking pin, a pair of plate parts, and a rod part for mounting the plate parts, and wherein the rod part has a stopper projection projecting upward.

5. A buckle according to claim 4, wherein the arm member blocks the push button from moving in the push button pushing direction by being rotated and thereby abutting against the stopper projection of the locking member.

6. A buckle according to claim 5, wherein the arm member includes the abutting part for abutting against the stopper projection of the locking member.

7. A buckle according to claim 1, wherein the arm member is biased in the direction opposite to the push button pushing direction by a torsional coil spring.

8. A buckle for a seat belt for keeping passengers of an automobile seated securely, comprising:

a buckle base;

an ejector for biasing a tongue plate inserted into the buckle base in the tongue plate extracting direction;

a latching member, journaled to the buckle base, for blocking the tongue plate from moving in the tongue plate extracting direction by latching the tongue plate inserted into the buckle base while opposing a biasing force of the ejector;

a locking member for regulating rotation of the latching member in the releasing direction, said locking member includes a locking pin, a pair of plate parts, and a rod part for mounting the plate parts, said rod part has a stopper projection projecting upward;

a push button for releasing the tongue plate from the latching member; and an arm member, rotatably supported by the push button, for blocking the push button from moving in the push button pushing direction when the push button is subjected to impact.

9. A buckle according to claim 8, wherein the arm member blocks the push button from moving in the push button pushing direction by being rotated and thereby abutting against the stopper projection of the locking member.

10. A buckle according to claim 8, wherein the arm member includes the abutting part for abutting against the stopper projection of the locking member.

* * * * *